US006540479B2

(12) United States Patent
Liao et al.

(10) Patent No.: US 6,540,479 B2
(45) Date of Patent: Apr. 1, 2003

(54) AXIAL FLOW FAN

(76) Inventors: William C. Liao, 2-1 Floor, 41, Sec. 2, Shen-Yang Rd., Taichung City (TW); Jian J. Yeuan, 2-1 Floor, 41, Sec. 2, Shen-Yang Rd., Taichung City (TW)

( * ) Notice: Subject to any disclaimer, the term of this patent is extended or adjusted under 35 U.S.C. 154(b) by 0 days.

(21) Appl. No.: 09/906,434

(22) Filed: Jul. 16, 2001

(65) Prior Publication Data

US 2003/0012646 A1 Jan. 16, 2003

(51) Int. Cl.[7] ..... F01D 1/02

(52) U.S. Cl. ..... 415/199.5; 415/191; 416/198 R; 416/244 R; 361/697

(58) Field of Search ..... 415/191, 199.5, 415/208.2, 211.2, 213.1; 416/198 R, 244 R; 361/697

(56) References Cited

U.S. PATENT DOCUMENTS 3,241,493 A * 3/1966 Frey
3,574,477 A * 4/1971 Dolf
5,611,668 A * 3/1997 Yapp et al. ..... 416/189
6,318,964 B1 * 11/2001 Yang ..... 416/185

* cited by examiner

*Primary Examiner*—Edward K. Look
*Assistant Examiner*—James M McAleenan
(74) *Attorney, Agent, or Firm*—Charles E. Baxley

(57) ABSTRACT

An axial flow fan includes a first rotor having first blades and a second rotor having second blades. The first rotor is axially connected to the second rotor, and both of the first rotor and the second rotor are received in a first stator which has third blades extending from radially inward from an inner periphery thereof. A second stator is connected to the first stator and has fourth blades extending radially inward from an inner periphery thereof.

5 Claims, 9 Drawing Sheets

AXIAL FLOW FAN

FIELD OF THE INVENTION

The present invention relates to an axial flow fan having dual rotors and dual stators so as to generate an air flow with higher pressure.

BACKGROUND OF THE INVENTION

A conventional axial flow fan for dispensing heat generated by a central processing unit of a computer is shown in FIG. 1 and generally includes a rotor 10 and a stator 11 which is located in alignment with the rotor 10 and a fan shaft rotates the rotor 10 to generate air flow by the blades on the rotor 10. The size of the axial flow fan used to dispense the heat in the computer is limited because the modern computers are required to be thin and minimized. The heat generated by Intel Pentium 4 is 55 watts so that it requires a fan with a specification of 40×40×28 mm and is operated at 9500 rpm to generate air flow of 15 cfm. The total area of the rotor 10 and the stator 11 is limited so that it cannot generate enough air flow to properly dispense the heat. The ideal ratio of the pressure surface S1 of the rotor 10 and the pressure surface S2 should be slightly less than one. However, the ratio of the conventional axial flow fan is far less than one.

The present invention intends to provide an axial flow fan that generates high pressure and high of air flow rate.

SUMMARY OF THE INVENTION

In accordance with one aspect of the present invention, there is provided an axial flow fan which comprises a first rotor having first blades extending radially outward therefrom and a second rotor connected to the first rotor has second blades extending radially outward therefrom. A first stator has third blades extending from radially inward from an inner periphery thereof and the first rotor and the second rotor are received in the first stator with the third blades located between the first blades and the second blades. A second stator is connected to the first stator and has fourth blades extending radially inward from an inner periphery of the fourth ring.

The primary object of the present invention is to provide an axial flow fan that has larger area of blades located axially in the fan so as to produce efficient air flow with higher air flow pressure.

The other object of the present invention is to provide an axial flow fan that has less loss of air flow pressure.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
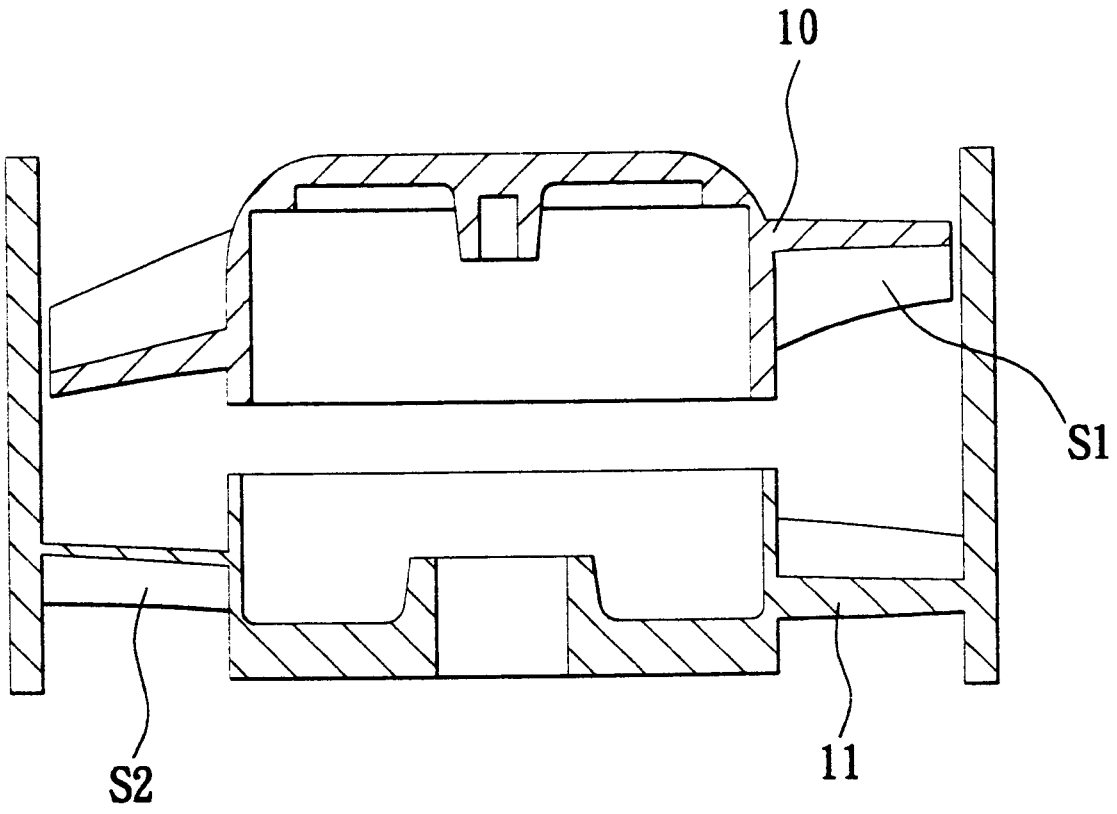
F I G. 1 PRIOR ART
FIG. 1 is a cross sectional view to show a conventional axial air flow fan.
Figure 2:
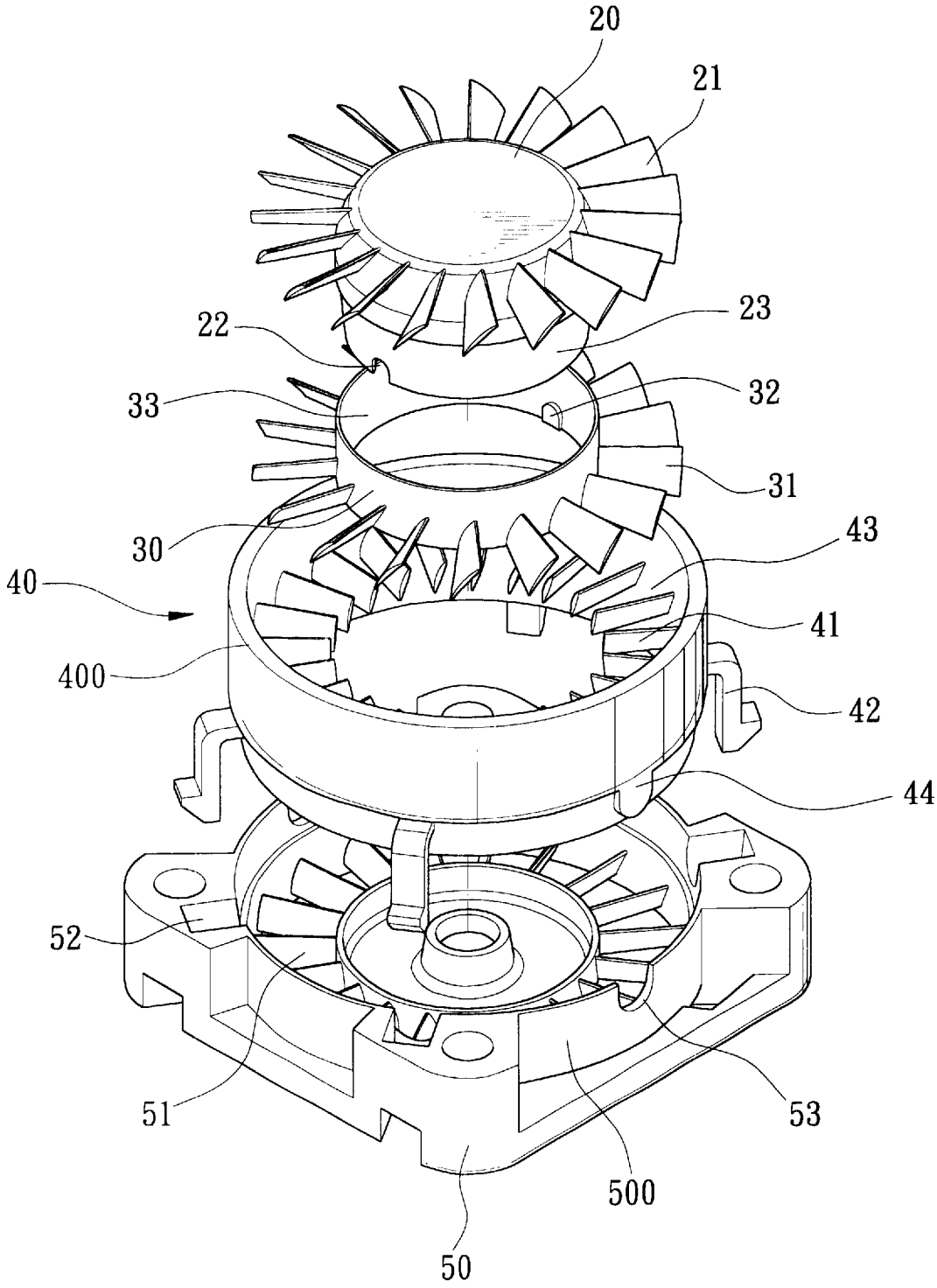
FIG. 2 is an exploded view to show an axial air flow fan of the present invention.
Figure 3:
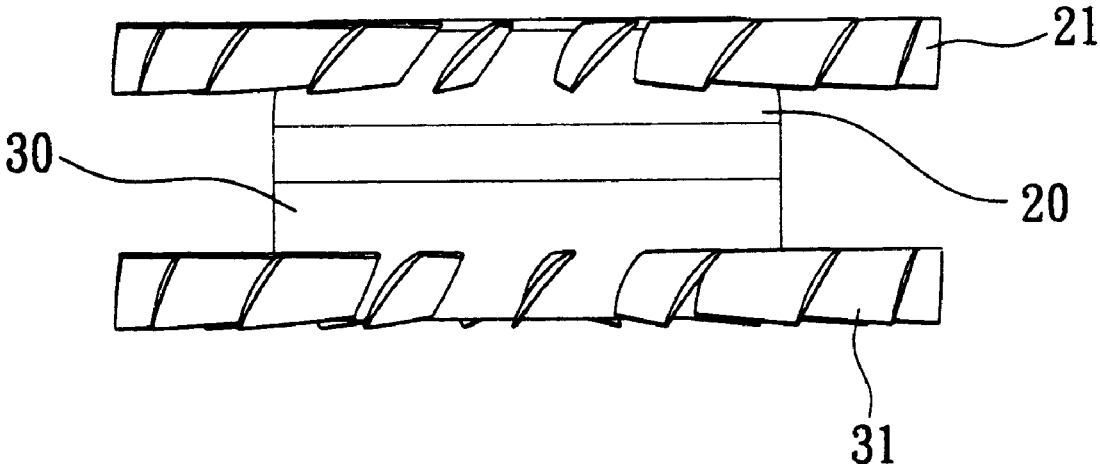
FIG. 3 is a plan view to show the connection of the first rotor and the second rotor of the axial air flow fan of the present invention.
Figure 4:
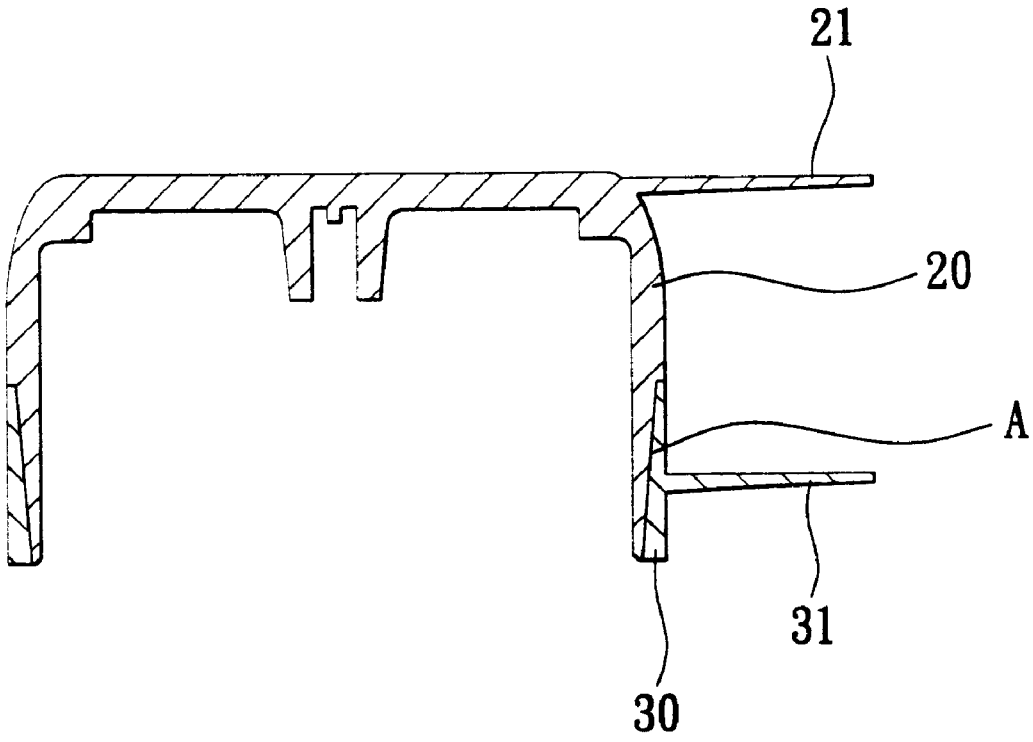
FIG. 4 is a cross sectional view to show the connection between the first rotor and the second rotor.

Referring to FIGS. 2 and 3, the axial flow fan of the present invention comprises a first rotor 20 having a first ring 23 with first blades 21 extending radially outward from the first ring 23. A second rotor 30 has a second ring 33 with second blades 31 extending radially outward from the second ring 33. The first ring 23 has notches 22 defined in a lower edge thereof and the second ring 33 has blocks 32 extending radially inward therefrom. As shown in FIG. 4, the first ring 23 has a first tapered surface defined in an outer periphery thereof and the second ring 33 has a second tapered surface defined in an inner periphery thereof. The first ring 23 is axially engaged with the second ring 33 with the blocks 32 engaged with the notches 22. The first tapered surface is securely engaged with the second tapered surface by welding or other proper method. The assembly of the first rotor 20 and the second rotor 30 is driven by a motor shaft (not shown).

Figure 5:
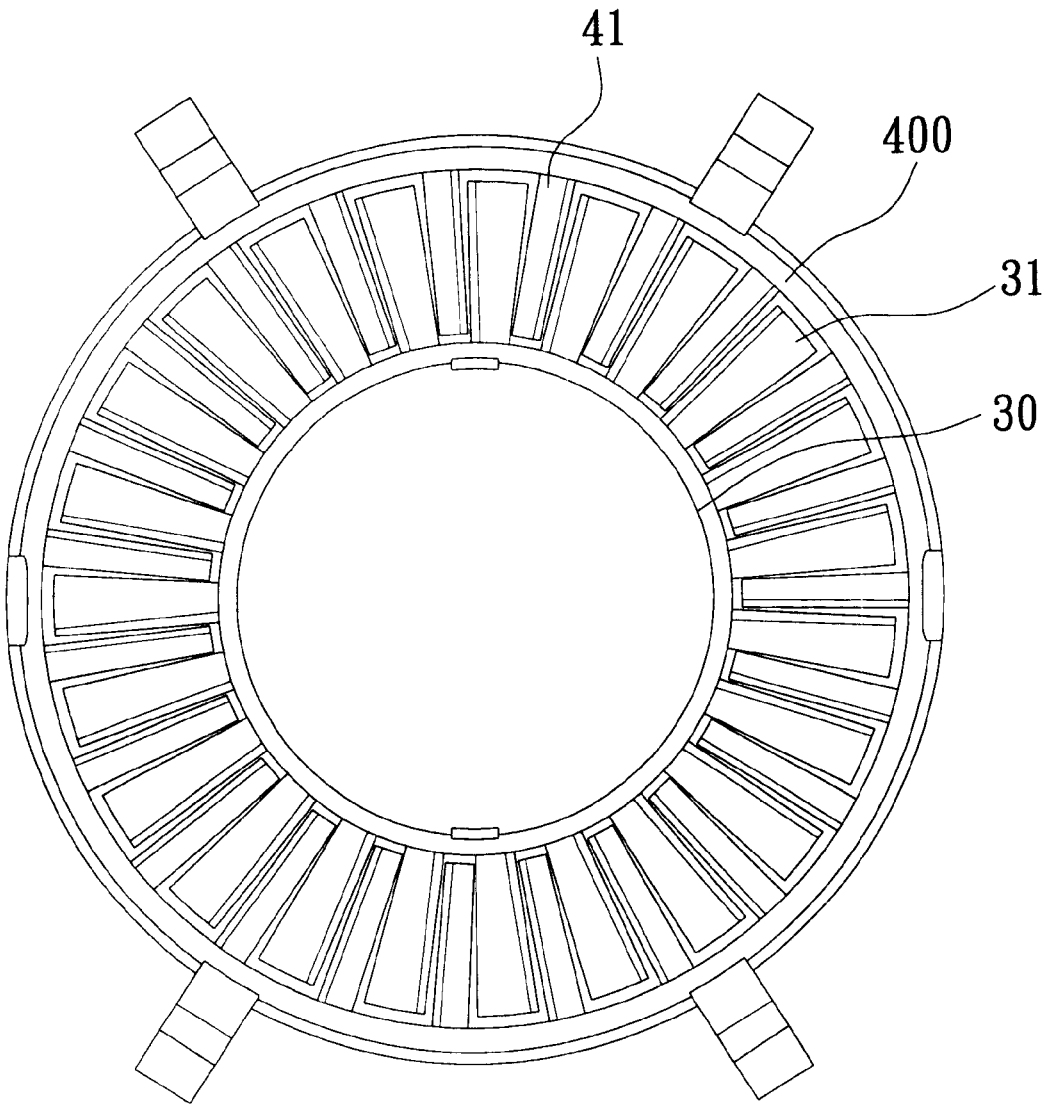
FIG. 5 is a top view to show the gaps between the blades of the first stator is large enough to let the blades of the second rotor to pass.
Figure 6:
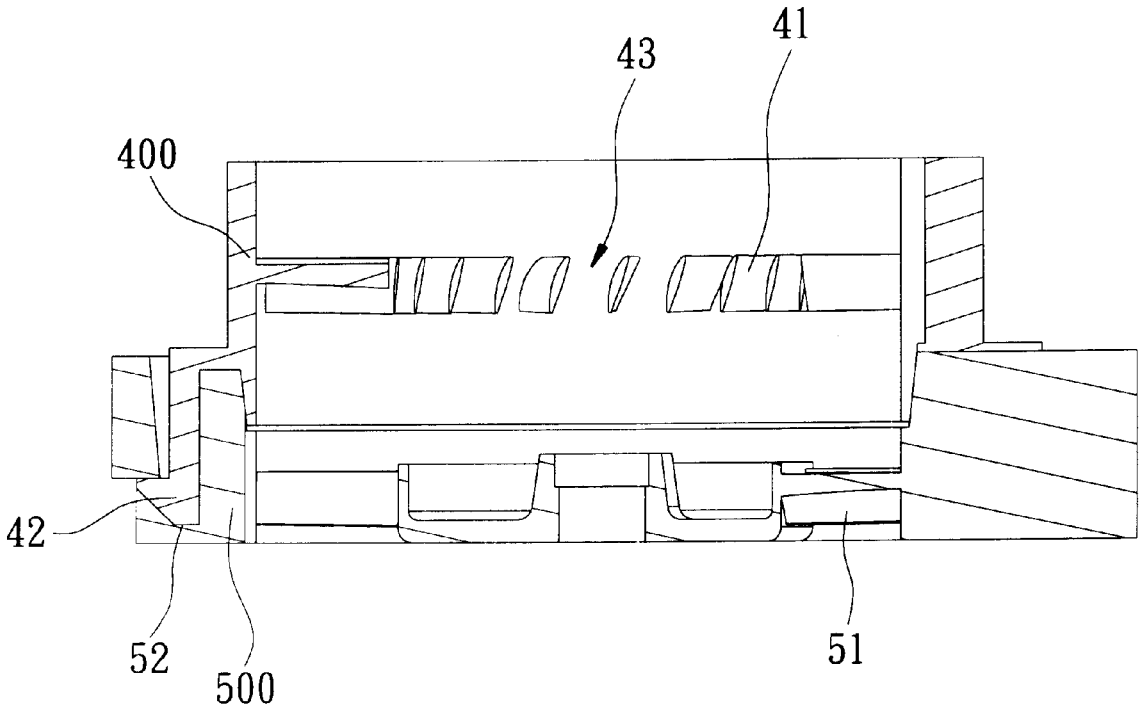
FIG. 6 is a plan view to show the connection of the first stator and the second stator of the axial air flow fan of the present invention.
Figure 7:
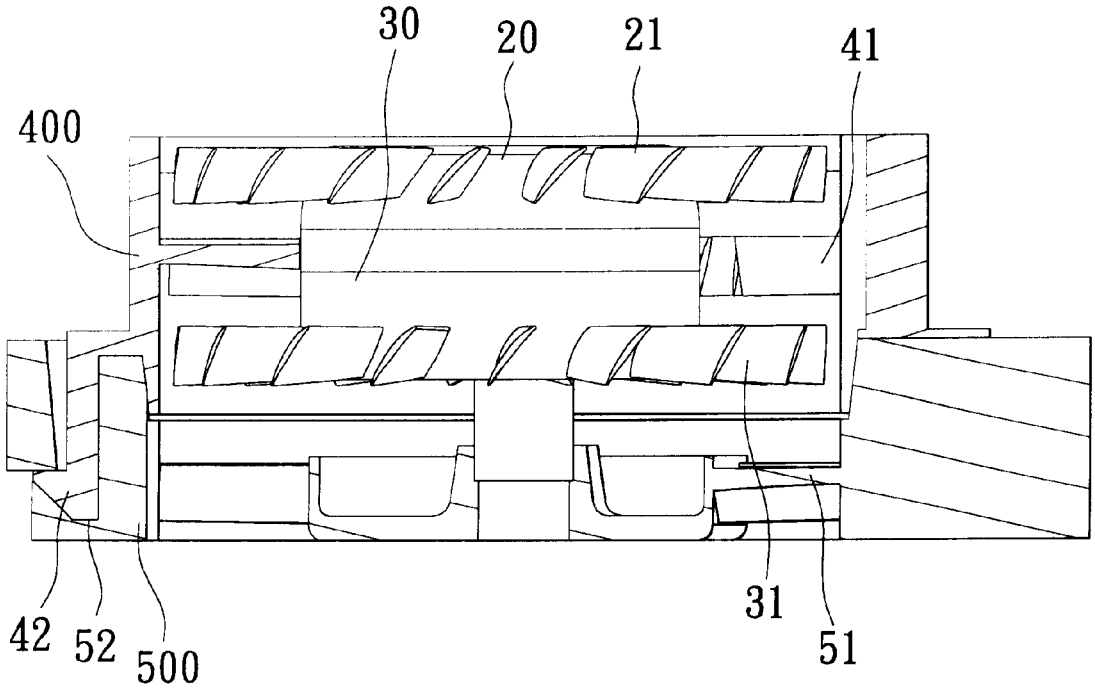
FIG. 7 is a cross sectional view to show the assembly of the first rotor and the second rotor is received in the first stator.

Referring to FIGS. 5 to 7, a first stator 40 has a third ring 400 and third blades 41 extend from radially inward from an inner periphery of the third ring 400. The gaps 43 between the third blades 41 are sized to allow the second blades 31 to pass so that the first rotor 20 and the second rotor 30 are received in the third ring 400 of the first stator 40 and the third blades 41 are located between the first blades 21 and the second blades 31. A second stator 50 is connected to the first stator 40 and has a fourth ring 500 with fourth blades 51 extending radially inward from an inner periphery of the fourth ring 500. The second stator 50 has four corner portions each of which has a holes 52 defined therein. The fourth ring 500 of the second stator 50 has recesses 53 defined in a top edge thereof. A plurality of engaging lugs 42 extend from an outer periphery of the third ring 400 of the first stator 40 and the engaging lugs 42 are received in the holes 52 of the second stator 50. A plurality of insertions 44 extend from an outer periphery of the third ring 400 of the first stator 40 and are received in the recesses 53 of the second stator 50.

Figure 8:
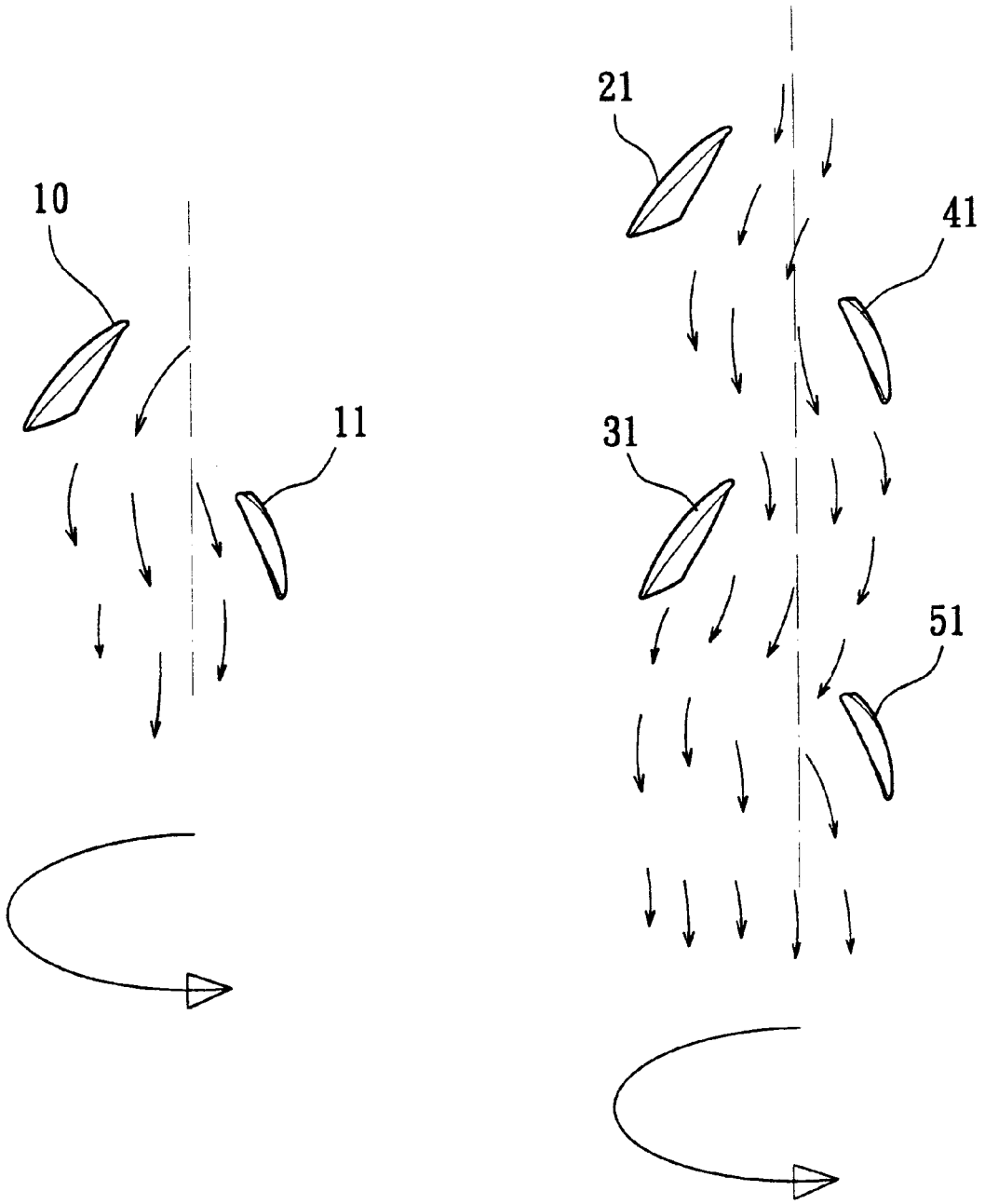
FIG. 8 is an illustrative view to show the comparison between the air flows generated by the conventional axial flow fan and the axial flow fan of the present invention.

Referring to the comparison figure as illustrated in FIG. 8, the tangential air flow or normal air flow generated by the first blades 21 are guided by the third blades 41 and the reaction force from the third blades 41 increases the pressure of the air flow and guides the air flow toward the axial direction. The air flow is then pressurized by the second blades 31 and guided to the second stator 50. Accordingly, the air flow is effectively pressurized and guided so that the loss of air flow pressure is minimized. On the contrary, the conventional fan can only generate a first stage of air flow which has a lot of pressure loss.

Figure 9:
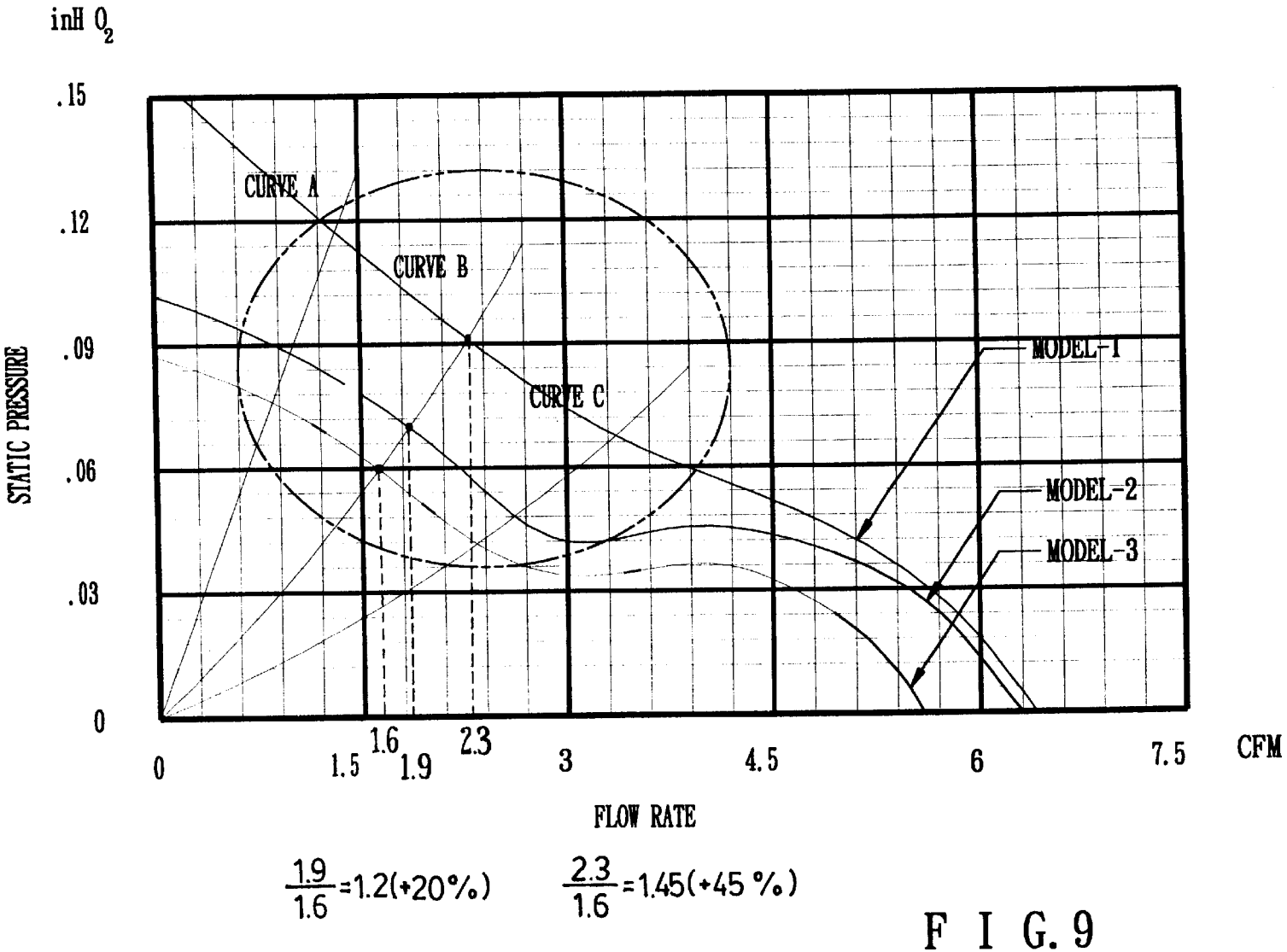
FIG. 9 is a static pressure vs. flow rate diagram which illustrates the comparison between the conventional axial flow fans and the axial flow fan of the present invention.

It is to be noted that heat dispensing fins or other cooling devices in the computer are located right at the outlet of the axial flow fan so that the static pressure in the air flow path will be increased. As shown in FIG. 9, the area between curve A and curve C is the static pressure and flow rate required for most heat dispensing systems. Model 3 and model 2 respectively represent the characters of two conventional axial flow fans. Model 1 is the performance curve of static pressure vs. flow rate of the present invention which is obviously increased when compared with the two conventional axial flow fans. At the practically operational circumstances, curve B, Model 1 is compared with Model 3 and gives 45% air flow rate rising which is much higher than 20% obtained from the comparison of Model 2 and Model 3.

While we have shown and described the embodiment in accordance with the present invention, it should be clear to those skilled in the art that further embodiments may be made without departing from the scope of the present invention.

What is claimed is:

1. An axial flow fan comprising:

a first rotor having a first ring with first blades extending radially outward from said first ring, a second rotor having a second ring with second blades extending radially outward from said second ring, said first rotor axially connected to said second rotor;

a first stator having a third ring and third blades extending from radially inward from an inner periphery of said third ring, said first rotor and said second rotor received in said third ring and said third blades located between said first blades and said second blades, a plurality of insertions extending from an outer periphery of said third ring of said first stator, and a second stator having recesses for receiving said insertions of said first stator so as to be connected to said first stator and having a fourth ring with fourth blades extending radially inward from an inner periphery of said fourth ring.

2. The axial flow fan as claimed in claim 1, wherein gaps between said third blades are sized to allow said second blades to pass.

3. The axial flow fan as claimed in claim 1, wherein said first ring has notches defined in a lower edge thereof and said second ring has blocks extending radially inward therefrom, said first ring engaged with said second ring and said blocks engaged with said notches.

4. The axial flow fan as claimed in claim 1 wherein said first ring has a first tapered surface defined in an outer periphery thereof and said second ring having a second tapered surface defined in an inner periphery thereof, said first tapered surface engaged with said second tapered surface.

5. The axial flow fan as claimed in claim 1 further comprising a plurality of insertions extending from an outer periphery of said third ring of said first stator and said second stator having recesses for receiving said insertions.

* * * * *